US005484496A

United States Patent [19]

Hackenberg

[11] Patent Number: 5,484,496

[45] Date of Patent: Jan. 16, 1996

[54] PROCESS FOR MANUFACTURING A PREFABRICATED BOW

[75] Inventor: Bernhard Hackenberg, Munchen, Germany

[73] Assignee: Landsberger Bandweberei GmbH & Co KG, Landsberg/Lech, Germany

[21] Appl. No.: 821,997

[22] Filed: Jan. 16, 1992

[30] Foreign Application Priority Data

| | | | |
|---|---|---|---|
| Jan. 22, 1991 | [DE] | Germany | 91 00 705.4 U |
| Apr. 11, 1991 | [DE] | Germany | 91 04 4308.8 U |
| Apr. 12, 1991 | [DE] | Germany | 41 12 039.6 |

[51] Int. Cl.[6] ..... D04D 7/10

[52] U.S. Cl. ..... 156/70; 223/46; 428/4; 428/101

[58] Field of Search ..... 428/4, 5, 101, 428/524.8; 28/147; 156/70; 223/46

[56] References Cited

U.S. PATENT DOCUMENTS

| | | | |
|---|---|---|---|
| 3,632,464 | 1/1972 | Grikis | 428/4 |
| 4,515,837 | 5/1985 | Cheng | 428/4 |
| 4,740,412 | 4/1988 | Hocker et al. | 428/194 |

*Primary Examiner*—Henry F. Epstein
*Attorney, Agent, or Firm*—Morgan & Finnegan

[57] ABSTRACT

This invention relates to a prefabricated bow product comprising at least one strip, which is formed with notches defining a plurality of loop-forming portions and optionally an end portion, and at least one tape, which extends beside the strip or between two such strips. Adjacent to the notches the at least one strip and the tape are loosely held together by a substantially annular clip. If two of such strips are provided, the strips and the tape are firmly joined at the end portion. To accomplish the object and to provide a prefabricated bow product which is friendly to the environment and yet has the properties required for a prefabricated bow product, two of the strips may be provided, which are parallel to each other, and at least such strips consist of paper and are joined in the end portion to the at least one tape by at least one clip. Alternatively, the object can be accomplished by a prefabricated bow product which comprises only one strip and, in accordance with the invention, such strip consists of paper. The invention provides also a process of manufacturing a prefabricated bow product and an apparatus for carrying out the process.

3 Claims, 2 Drawing Sheets

PROCESS FOR MANUFACTURING A PREFABRICATED BOW

BACKGROUND OF THE INVENTION

1. Field of the Invention

This invention relates to a prefabricated bow product, to a process of manufacturing a prefabricated bow product, and to an apparatus for carrying out the process.

2. Description of the Prior Art

Known prefabricated bow products made of plastic consist of two strips and are formed with notches, which define an end portion and a plurality of loop-forming portions. Such bow products comprise between the strips at least one tape and the strips and the tape are firmly joined in the end portion and at the notches are loosely held together by an almost annular clip. Other known prefabricated bow products made of plastic consist of a strip, which has notches, which define a plurality of loop-forming portions. A tape extends along the strip and at the notches is loosely held together with the strip by substantially annular clips. Such prefabricated bow products are used for decorative purposes, e.g., in the packaging of presents. The bow products have the advantage in that they are manufactured as a multilayer strip for storage and transportation and can readily be transformed into a highly decorative bow in order to form the loops. To do so, it is sufficient to simply grasp the bow product firstly described hereinabove at one free end and to grasp the bow product lastly described hereinabove at both free ends of the narrower tape and to push the substantially annular clips together and toward the end portion. The known prefabricated bow products generally consist entirely of plastic, in most cases of polypropylene, so that in the manufacture of the prefabricated bow products the joint at the end portion can simply be made so that the superimposed strips and tapes are welded together by means of welding jaws which move toward each other.

The prefabricated bow products described hereinabove have previously been made by tedious manual work. Whereas the strip or strips are formed with alternate notches by machine in the previous practice, the joints connecting the strip to the pulling tapes and to any second strip are made by hand and that job is presently performed in low-wage countries as piece work.

From an ecological aspect, it is increasingly required that all-plastic products be substituted with materials which are more friendly to the environment. This is mainly due to the fact that plastic products which, after use, are placed on a dump will give rise to problems.

SUMMARY OF THE INVENTION

It is a first object of the invention to provide a prefabricated bow product which is ecologically innocuous and yet embodies the features which are required in a prefabricated bow product.

It is a second object of the invention to provide for the automatic manufacture of bow products of the kind firstly described hereinabove by a process which permits such bow products to be made from any desired flexible materials.

It is a third object of the invention to provide an apparatus for carrying out the process.

In accordance with an initial aspect of the invention, the first object of the invention is accomplished by providing a bow product which comprises at least two parallel strips which consist of paper and which are joined to the at least one tape in the end portion by means of at least one clip.

In accordance with a second aspect of the invention, the first object is accomplished by providing a bow product comprising only a single strip which consists of paper.

This invention is based, in the first place, on the recognition that paper, which is more compatible with the environment can be used to form the loops, which mainly determine the appearance of the prefabricated bow, whereas the appearance of the bow will not be disturbed by a buckling of the strips adjacent to the bends of the loops. In a bow product which comprises two parallel strips of paper, the problem arising from the non-weldability of the paper is solved by the provision of a clip adjacent to the end portion of the prefabricated bow product.

According to a preferred feature in accordance with the first aspect of the invention, two tapes, which are narrower than the strips, are provided between the strips.

A tape or the tapes may be made of an ecologically innocuous textile fabric, preferably cotton. Alternatively, a tape or tapes may consist of plastic-coated paper tapes, such as are described in German Utility Model Application G 90 06 441 of the same applicant. Such plastic-coated paper tapes afford an advantage in that they can be crimped so that when the annular clips have been pushed toward each other to form the prefabricated bow the remaining tape portions can be crimped by being drawn over a sharp edge so that the decorative effect will further be increased.

The strips which constitute the loops may be printed with ecologically innocuous watercolors. Reclaimed paper may preferably be used for the strips.

The second object stated above is accomplished in accordance with the invention by bringing together and intermittently advancing at least one strip and at least one tape which is narrower than the strip, and while guiding the relatively narrow tape to extend centrally of the strip. After each feeding step, notches are cut into the side edges of the strip. Immediately after the notches have been formed, the strip and the narrower tape are loosely held together at the notches by a substantially annular clip. When the assembly consisting of the strip and the narrow tape held together has reached a desired length, said assembly is cut off.

According to a special feature of the process, two elongate strips and the narrower tape are fed in an arrangement in which the strips are parallel and the narrower tape extends between the elongate strips and whenever the tape has been fed to the desired length, the strips and tape are joined by a clip which extends substantially in the feeding direction of the strips, and the strips and tape are severed behind each clip.

In such special embodiment of the process the prefabricated bow product can be made from two parallel strips and an interposed pulling tape. This embodiment of the process permits the use of any desired flexible materials, such as paper and woven fabric, for the manufacture of the prefabricated bow products because the strips are joined to the pulling tape in the end portion by a longitudinally extending clip.

According to a further desirable feature of the process the longitudinal clip can be applied immediately after the notches have been formed. This is particularly desirable because after the notching operation the narrower tapes must extend centrally between the strips. Such disposition thereof ensures that the superposed elongate strips and tapes will be joined by the longitudinally extending clip.

According to a further desirable feature of the process, the waste chips which have been notched out of the strip are sucked off during and immediately after the notching operation and are collected. In such a case the waste chips can be recycled.

The third object set forth hereinabove is accomplished in accordance with the invention by an apparatus which comprises at least one pay-off device for delivering the relatively narrow tape and at least one pay-off device for delivering the strip. The pay-off devices are succeeded by a first guide plate. A notching device, a device for applying a longitudinal clip, a device for applying a transverse clip, a strip feeder and a strip cutter are consecutively arranged in the direction of travel of the strip, in that order.

According to a preferred feature of the apparatus described hereinabove, the notching device, the device for applying the longitudinal clip and the strip feeder are each preceded by an additional guide plate and the strip feeder is succeeded by a further guide plate. These additional and further guide plates are intended to ensure that the strip or strips and the tape or tapes are properly aligned with each other.

If the apparatus comprises two pay-off devices for two strips, it has been found to be particularly desirable to provide at least one guide plate which precedes the notching device and which has two parallel slots for guiding the strips and a third guide slot, which is disposed centrally between the strip-guiding slots and serves to guide the at least one narrow tape.

According to a further feature of the apparatus in accordance with the invention a welding device is provided between the strip feeder and the strip cutter. If the apparatus is intended to be used also to manufacture prefabricated bow products made of polyethylene, the welding device will be used to properly weld the end portion. In such case a longitudinal clip will not be applied to the end portion, but the function of such longitudinal clip will be replaced by a welded joint formed by the welding device.

The invention relates also to prefabricated bow products made by the process in accordance with the invention. The prefabricated bow products desirably comprise at least on paper strip and preferably consists of cotton or jute. The narrower tape may alternatively consist of plastic or of plastic-coated paper. Such an embodiment is particularly desirable from the aspect of ecology because it is increasingly required to replace all-plastic products by materials which are more friendly to the environment. This is mainly due to the fact that plastic products will give rise to problems when they are finally dumped after use. Such problems will not arise if strips made of paper and relatively narrow tapes made of cotton or jute are employed.

From the aspect of ecology, it is particularly desirable to use watercolors for printing on the strips made of paper.

Other prefabricated bow products which are in accordance with the invention and can be made by the process described hereinbefore are characterized by the fact that the at least one strip and the at least one narrow tape are made of woven fabric, preferably of polyester or cotton.

Finally, the process can desirably be used to make prefabricated bow products, for which independent protection is claimed and in which either the at least one strip consists of woven fabric, preferably of polyester or cotton, and the at least one narrow tape consists of a polypropylene tape. Conversely, the at least one strip may consist of a smooth polypropylene strip and the at least one narrow tape may consist of a woven tape, preferably of polyester or cotton.

DETAILED DESCRIPTION OF THE PREFERRED EMBODIMENTS

Figure 1:
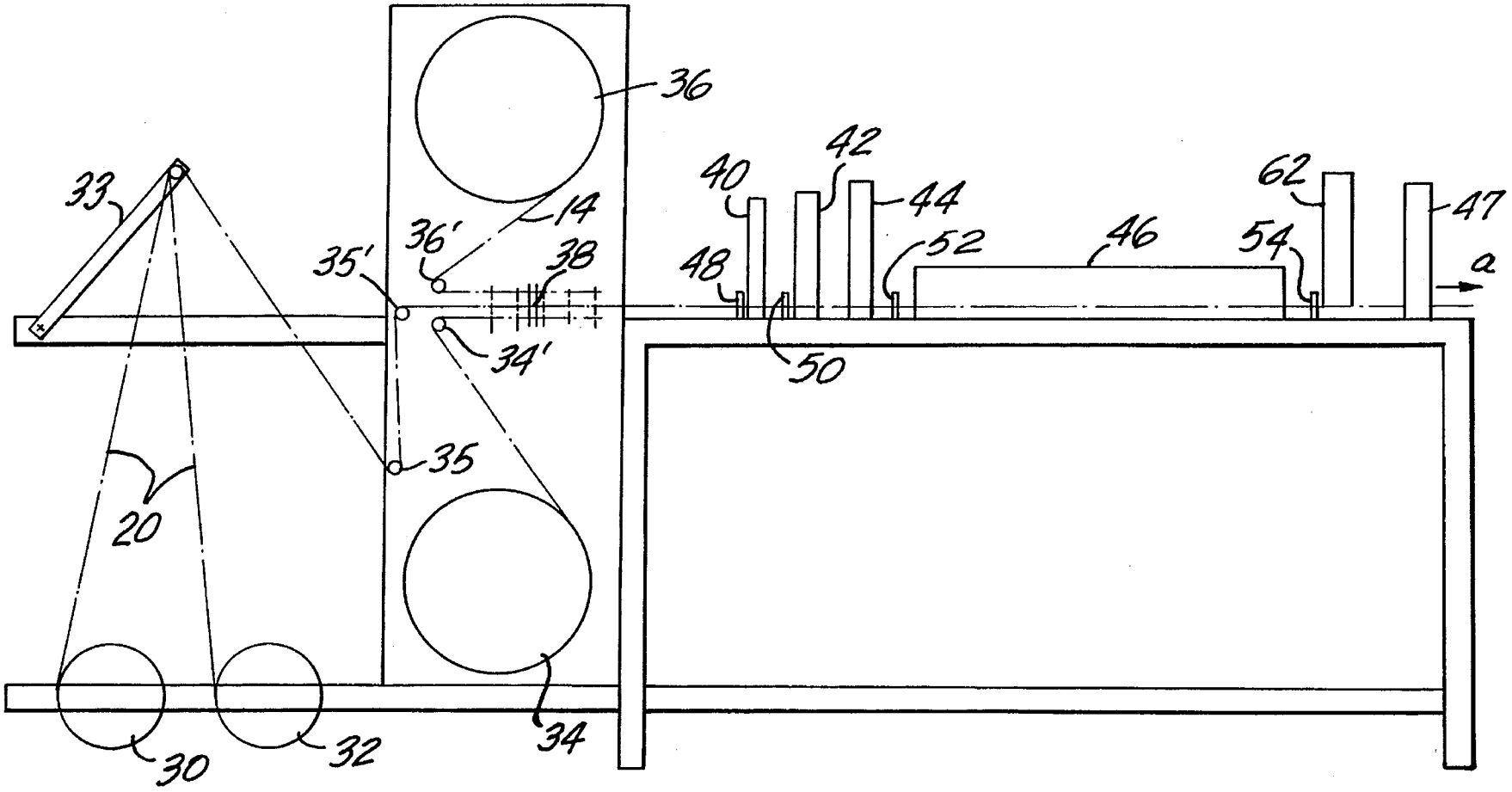
FIG. 1 is a schematic side view in elevation showing an embodiment of an apparatus for carrying out the process in accordance with the invention.

Further details and advantages of the invention will be explained hereinafter with reference to an embodiment shown by way of example in the drawings.

As is shown in FIG. 1, pay-off devices, 30 and 32, for two cotton tapes about 3.5 mm wide each are installed in a machine frame. The cotton tapes 20 are snubbed as they are withdrawn from the pay-off devices and are trained around a dancer 33 and around deflecting rollers 35, 35'. Additional pay-off devices 34 and 36 are installed in the machine frame on opposite sides of the courses of the cotton tapes and deliver strips which have a width of abut 24 mm and consist of paper printed with watercolors. Such paper strips are trained around deflecting rollers 34' and 36' as is shown in FIG. 1.

Figure 3:
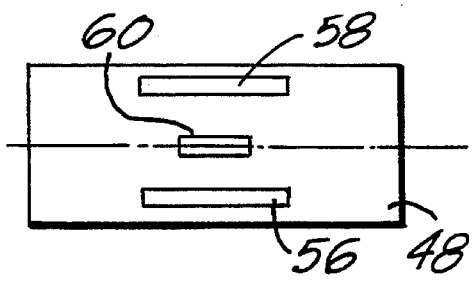
FIG. 3 is an embodiment of a guide plate used in the apparatus of FIG. 1.

A guide plate 38 is provided for guiding the strips 12 and 14 and the cotton tapes 20 in alignment with each other. The guide plate 30 has a configuration which will be described hereinafter for the guide plate 48 shown in FIG. 3. When the strips and tapes have thus been brought together, they are intermittently withdrawn from the pay-off devices 30, 32 and 34, 36 by a strip feeder 46. The strip feeder 46 is preceded by a notching device 40, which is mounted on the machine stand and comprises two circular punches for cutting the notches 15 (see FIG. 2*a*) into the strips 12 and 14. The ensure that the tapes 20 will not be damaged by the notching operation, the tapes 20 must be guided to extend exactly centrally between the strips 12, 14. This is ensured by the guide plate 48, which is shown in FIG. 3 and is formed with two slots 56 and 58 for guiding the strips 12 and 14, respectively, and with a slot 60 for guiding the centrally extending tapes 20.

The apparatus also comprises a sucking device, which is not shown in FIG. 1 and serves to suck off the paper chips cut off by the notching operation. Such chips are delivered to collecting means.

Figure 4:
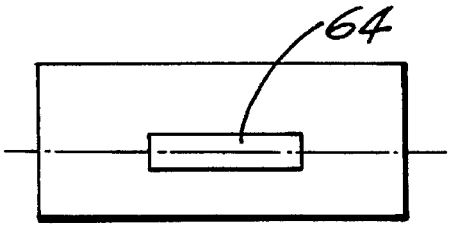
FIG. 4 shows an embodiment of an additional guide plate for use in an apparatus as shown in FIG. 1.

The notching device is succeeded by a longitudinal clip applicator 42, which serves to apply a longitudinally extending retaining clip 22 (see FIGS. 2*a* and 2*b*) to each portion of the strip and tape assembly which is intended to constitute an end portion of the prefabricated bow product. A hold-down guide plate 50 is provided between the notching device 40 and the longitudinal clip applicator 42 and as shown in FIG. 4 has only one central slot 64, which has approximately the same width as the paper strips 12 and 14 and has such a height that all strips 12 and 14 and tapes 20 can pass through the slot. The longitudinal clip applicator 42 is succeeded by a transverse clip applicator 44, which serves to apply the clips 19 shown in FIGS. 2*a* and 2*b* at the notches 15. The strip feeder is succeeded by a strip cutter 47, by which the assembly consisting of the strips and tapes is severed behind the previously applied longitudinal clip 22 whenever a said assembly has been fed in a desired length.

As is apparent from FIG. 1, an additional guide plate 52 is provided between the transverse clip applicator 44 and the strip feeder 45 and a guide plate 54 is provided between the strip feeder 46 and the strip cutter 47.

The embodiment shown also comprises a welding device 62, which is used if the prefabricated bow products are to be made entirely of plastic rather than of the materials described hereinabove. In that case the strips 12, 13 and the tapes 20 are not joined by a longitudinal clip 22 but by a seam weld formed by the welding device 62. The welding device 62 succeeds the strip feeder 46 because it is not essential in such a case to arrange the tapes 20 exactly centrally in the end portion which is to be welded. This is due to the fact that the seam weld extends over a substantial part of the width of the strip-tape assembly whereas the longitudinal clip must be applied in a very narrow region to the rather narrow tapes 20.

Figure 2A:
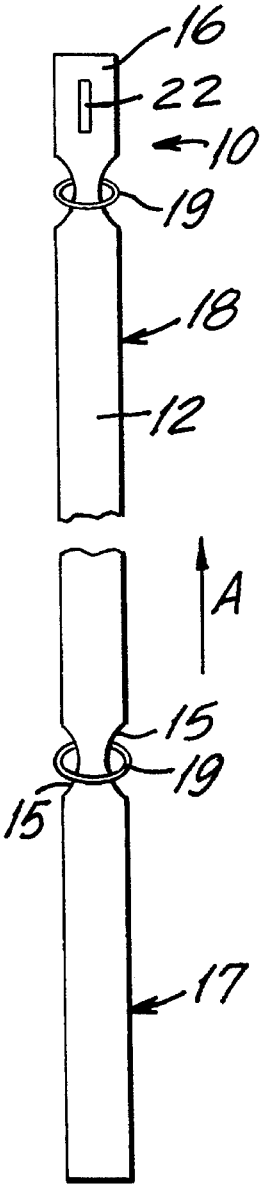
FIGS. 2*a* and 2*b* are, respectively, a top plan view and a longitudinal sectional view showing a prefabricated bow product, which can be made with the apparatus shown in FIG. 1.
Figure 2B:
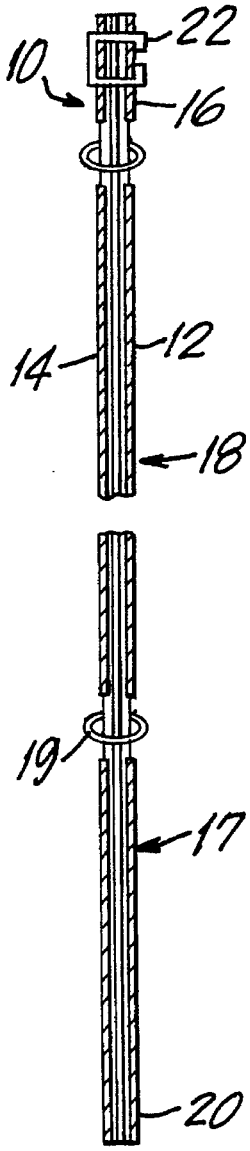

The prefabricated bow product 10 is shown in FIGS. 2*a* and 2*b* in an extended form and comprises two strips 12 and 14, which are made from reclaimed paper, which is printed with watercolors, which are friendly to the environment. The strips 12 and 14 are provided on both sides with notches 15 at longitudinally spaced apart points. The notches 15 define an end portion 16, a plurality of loop-forming portions 18 and free ends 17. The portions are connected by webs left between the notches 15. Dyed cotton tapes 20 extend between the strips 12 and 14 and have approximately the same width as the webs left in the strips 12 and 14 between adjacent notches 15. The strips 12 and 14 and the tapes 20 are firmly joined near the end portion by a metal clip 22. At each pair of notches 15, the webs left in the strips 12 and 14 and the tapes between the strips 12 and 14 are loosely held together by substantially annular clips 19.

When the substantially annular clips 19 are pushed together along the tapes 20, the plurality of consecutive loop-forming portions 18 will form the decorative loops of the prefabricated bow 10.

Only one loop-forming portion 18 of each strip is shown in FIGS. 2*a* and 2*b*. It will be understood that depending on the desired shape of the prefabricated bow 10 each strip 12 or 14 will comprise a plurality of consecutive loop-forming portions. Prefabricated bows which are highly decorative and bulky may be made, e.g., with about ten or more loop-forming portions in each strip. When the prefabricated bow has been formed with loops, the free end portions 17 will protrude downwardly and simulate the free ends of an actually tied bow. The dyed cotton strips 20 may be used also to tie a parcel.

I claim:

1. A process for manufacturing a prefabricated bow product comprising feeding intermittently in the same direction to a desired length, in a spaced, parallel, superposed relationship at least one elongate strip and at least one elongate tape which is narrower than said strip while guiding said strip and said tape in said spaced, parallel, superposed relationship, forming notches intermittently in the longitudinal edges of said strip, joining said strip and said tape in a superposed relationship behind said notches with a longitudinal clip extending substantially longitudinally in the direction of feed of said strip and said tape after said notches have been formed, disposing substantially annular clips around said strip in said notches, severing said strip and said tape behind said longitudinal clip, and forming said prefabricated bow product.

2. A process according to claim 1 comprising feeding two elongate strips and one elongate tape which is narrower than said strips in a spaced, parallel, superposed relationship with said tape extending between said strips and joining said strips and said tape in a superposed relationship with a longitudinal clip.

3. A process according to claim 1 including sucking off and collecting waste chips notched out of the strip during and immediately after the notching operation.

* * * * *